United States Patent [19]

Schlonski

[11] Patent Number: 4,654,190

[45] Date of Patent: Mar. 31, 1987

[54] EMERGENCY FEEDWATER SYSTEM FOR STEAM GENERATORS OF A NUCLEAR POWER PLANT

[75] Inventor: James S. Schlonski, Monroeville, Pa.

[73] Assignee: Westinghouse Electric Corp., Pittsburgh, Pa.

[21] Appl. No.: 596,879

[22] Filed: Apr. 5, 1984

[51] Int. Cl.[4] ..... G21C 19/00

[52] U.S. Cl. ..... 376/282; 376/246; 376/247; 376/298

[58] Field of Search ..... 376/246, 247, 282, 298

[56] References Cited

U.S. PATENT DOCUMENTS

| | | | |
|---|---|---|---|
| 3,431,168 | 3/1969 | Kjemtrup | 176/50 |
| 3,839,150 | 10/1974 | Porter | 60/422 |
| 3,873,817 | 3/1975 | Liang | 376/245 X |
| 3,892,625 | 7/1975 | Patterson | 176/55 |
| 3,981,770 | 9/1976 | Middleton | 376/282 |
| 3,998,053 | 12/1976 | Johnson | 176/51 |
| 4,035,231 | 7/1977 | Ventre | 176/38 |
| 4,064,002 | 12/1977 | Desmarchais et al. | 176/38 |
| 4,071,403 | 1/1978 | Andrews et al. | 376/281 |
| 4,367,194 | 1/1983 | Schenewerk et al. | 376/281 |
| 4,526,742 | 7/1985 | Hannerz | 376/282 |

*Primary Examiner*—Peter A. Nelson

*Attorney, Agent, or Firm*—Daniel C. Abeles

[57] ABSTRACT

An emergency feedwater system for the steam generators of a pressurized water nuclear reactor has two separately located subsystems, each subsystem supplying water to at least one steam generator when activated, where each subsystem contains an emergency feedwater supply tank, and a pair of emergency feedwater lines leading from the tank which communicate with the inlet line of a steam generator. An electrical operated motor driven pump is located in one of said pair of emergency feedwater lines and a steam turbine driven pump in the other of said pair, with a cavitating venturi provided in an emergency feedwater line between the pump and inlet line of the steam generator. The system is adaptable for use with two, three, and four loop pressurized water reactor systems.

15 Claims, 3 Drawing Figures

EMERGENCY FEEDWATER SYSTEM FOR STEAM GENERATORS OF A NUCLEAR POWER PLANT

FIELD OF THE INVENTION

The present invention relates to an emergency feedwater system to provide emergency feedwater to the steam generators of a pressurized water reactor so as to cool the reactor in the event of a failure of a main feedwater system to a steam generator.

BACKGROUND OF THE INVENTION

In pressurized water reactors for the nuclear production of power, a pressurized fluid is passed through the reactor core and, after being heated in the core, is passed through heat transfer tubes that are positioned in a secondary side of a steam generator. In the secondary side of the steam generator, the heat transfer tubes transfer heat to a secondary fluid to produce steam that is then used to operate a turbine for production of electrical power.

The provision of emergency feedwater systems for the secondary side of the steam generators of a pressurized water reactor is made in order to supply feedwater to the steam generators following an accident or transient conditions when the main feedwater system is not available, thereby maintaining the capability of the steam generators to remove plant stored heat and reactor core decay heat by converting the emergency feedwater to steam which may then either be discharged to the condensor or to the atmosphere.

Such emergency feedwater systems generally comprise a source of emergency feedwater, such as a supply of water contained in a storage tank, and associated lines, pumps and valving systems to direct the emergency feedwater, when necessary, to the steam condensors. In order to assure operation of the system under various adverse conditions, means must be provided to effect operation of the emergency feedwater system for example in the event of loss of electrical power, or in the event of a passive failure such as a pipe rupture or an active failure such as a failure of a valve to respond to a signal to open or close. In addition, provision should be made to address even remote possibilities of interruption of an emergency feedwater system, such as fires or other external events, such as air craft impacts, explosions, or the like, which might impair the operability of the system.

SUMMARY OF THE INVENTION

An emergency feedwater system for the steam generators of a pressurized water nuclear reactor power plant contains two separately located subsystems. Each subsystem comprises an emergency feedwater supply tank, and a pair of emergency feedwater lines for discharge of water from the tank to the inlet line of a steam generator. An electrically operated motor driven pump is located in one of said pair of emergency feedwater lines, and a steam driven turbine pump is located in the other of said pair of emergency feedwater lines. A cavitating venturi is provided in the emergency feedwater line between the pumps and the inlet line to a steam generator.

In the embodiment for a four loop system, a cavitating venturi is provided in each of the emergency feedwater lines, with one feedwater line provided for each of four steam generators, and connecting lines are provided between each pair of emergency feedwater lines.

In the embodiment for a three loop system, one of each of said pair of emergency feedwater lines of a subsystem charges emergency feedwater to separate first and second steam generators, while the other of each of said pair of emergency feedwater lines combine to form a common discharge line to a third steam generator. A cavitating venturi is provided in each of said feedwater lines to the first and second steam generators and a further cavitating venturi is provided in the common discharge line.

In the embodiment for a two loop system, each pair of emergency feedwater lines of a subsystem combine to form a common discharge line to separate ones of the two steam generators, and a cavitating venturi is provided in each of the two common discharge lines.

DETAILED DESCRIPTION

The emergency feedwater system of the present invention provides for the separation of the feedwater supply into two separate subsystems and may be used in connection with two loop, three loop or four loop pressurized water reactor plants, the loop designation referring to the number of generators associated with a pressurized water nuclear reactor.

Figure 1:
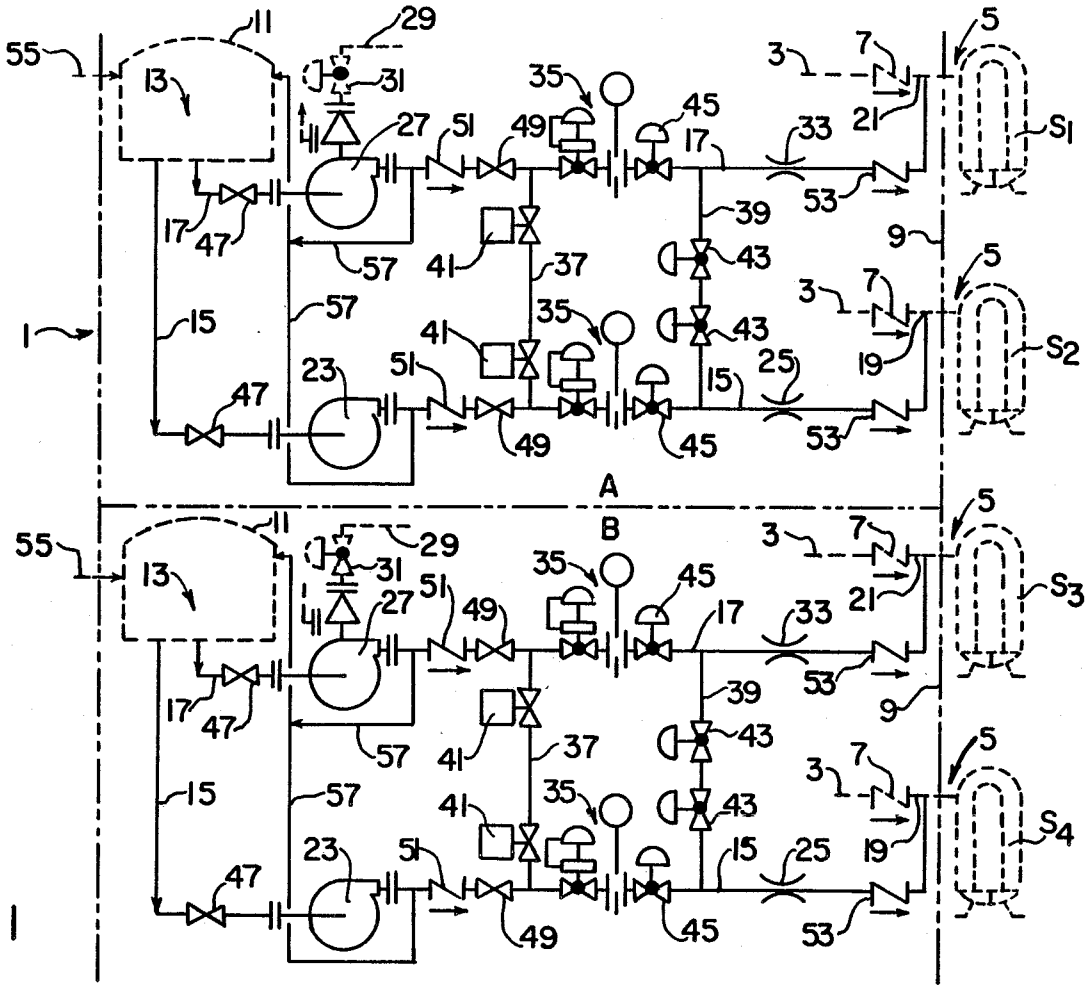
FIG. 1 is a schematic illustration of the emergency feedwater system of the present invention for use with a four loop steam generation system.

Referring now to FIG. 1, an emergency feedwater system 1, is illustrated for use with a four loop system, one containing four steam generators $S_1$, $S_2$, $S_3$, $S_4$. As is conventional in such a four loop system, each of the steam generators $S_1$, $S_2$, $S_3$ and $S_4$ has a respective main feedwater system which supplies water to a respective generator through an inlet line 3, the line terminating at the steam generator at a nozzle 5, and having a check valve 7 therein, the check valve 7 being positioned in the inlet line 3 at a location outside the containment wall 9 which contains the reactor and associated equipment.

In accordance with the present invention, two separate subsystems, designated as A and B are provided, each subsystem servicing a pair of generators. As indicated, area A services steam generators $S_1$ and $S_2$. The subsystems are located at separate physical locations and preferably, one such subsystem is provided on the opposite side of the containment from the other subsystem.

Each subsystem contains the components for charging the steam generators with 'emergency feedwater, and in the interest of brevity, specific description of the subsystem area A will be made. The subsystem, area A, comprises an emergency feedwater tank 11 containing a supply of emergency feedwater 13. Leading from the emergency feedwater tank 11 are a pair of emergency feedwater lines 15 and 17. Emergency feedwater line 15 communicates with the inlet line 3 to steam generator $S_2$ at 19, at a location between check valve 7 and nozzle 5, while the emergency feedwater line 17 communicates with the inlet line 3 to steam generator $S_1$ at 21, at a location between check valve 7 and nozzle 5.

In emergency feedwater line 15, there is provided a motor operated pump 23 which is electrically operated and has an electrical power source for activating the pump to discharge water from the emergency feedwater tank 11. Also provided in emergency feedwater line 15, between pump 23 and the communication of the line to inlet line 3 of steam generator $S_2$ at 19, there is a cavitating venturi orifice 25.

In emergency feedwater line 17, there is provided a steam turbine driven pump 27. A steam supply line 29 provides steam from the main steam system of the steam generator $S_1$ and contains a valve means 31, such as a pneumatically-operated steam admission valve, which is in normally closed position. Activation of the steam driven pump will also discharge water from the emergency feedwater tank 11. In emergency feedwater line 17, between pump 27 and the communication of the line to inlet line 3 of steam generator $S_1$ at 21, there is a cavitating venturi orifice 33.

The cavitating venturies 25 and 33 are sized to cavitate and choke emergency feedwater flow in the emergency feedwater lines 15 and 17 to a specified flow. The cavitating venturies serve several purposes. In the event of a steamline or feedline rupture, the pumps 23 and 27 will discharge to a reduced pressure. In such cases, the cavitating venturies will choke the flow in each line to the specified flow and thereby prevent the pumps from being damaged by runout. Also, in the event of a steamline rupture, with all pumps operating, the cavitating venturies 25 and 33 prevent an excessive flow of emergency feedwater to the steam generators which could cause an unacceptably high cooldown rate of reactor coolant system components. Also, by limiting the emergency feedwater flow to the steam generators in the short term (i.e., before operator action can be assumed), the cavitating venturies prevent the steam generators from being filled solid with water and prevent the attendant problem of steamline flooding. In addition, in the event of a steamline rupture inside the containment, the cavitating venturies limit the emergency feedwater system contribution to the mass and energy released to the containment. Also, with use of a cavitating venturi in each of the emergency feedwater lines to each steam generator, a nearly balanced flow distribution can be maintained in the event of a steamline or feedline break, when one steam generator is depressurized to atmospheric pressure and the other intact steam generator is at design pressure. During normal emergency feedwater flow rates, the venturies will not cavitate and the permanent head loss caused by the cavitating venturies will be considerably less than that of an equivalent orifice.

Flow modulating valves 35 are provided in each emergency feedwater lines 15 and 17 between the respective pumps 23 and 27 and the cavitating venturi orifices 25 and 33. These flow modulating valves 35 are normally open, fail open, air operated, hand controlled valves. A local namual override is provided on these valves to allow positioning of the valve in the event of loss of air, or a failure in the valve control circuitry. First and second connecting lines 37 and 39 are also provided which communicate between the emergency feedwater lines 15 and 17, one before and the other following the location of the flow modulating valves 35. The first connecting line 37, located between the pumps 23 and 27 and the flow modulating valves 35, contains valve means, such as motor operated valves 41 which are in a normally open position. These valves 41 allow the individual pumps to be remotely isolated from each other in the event of a passive failure, such as a pipe leak, while a local manual override is provided on each valve 41 to allow manual positioning in the event of control failure. The second connecting line 39, located between the flow modulating valves 35 and the cavitating venturi orifices 25 and 33, contains valve means, such as air operated valves 43, in a normally open position. These valves 43 allow the individual pumps to be remotely isolated from each other in the event of a passive failure or to establish individual steam generator flow control. Closure of one of the valves also terminates flow to a faulted steam generator following a feedline or steamline break to the generator.

Each of the emergency feedwater lines 15 and 17 also are provided with valve means 45, such as an air operated, normally open, fail open, isolation valve downstream of the flow modulating valves 35. These valves 45 are used to isolate emergency feedwater flow to a faulted steam generator following a main feedline or main steamline rupture. These valves 45 can also be used for maintenance operations, or in the event of a passive failure, such as a pipe leak, and during such situations, serve as a barrier between the emergency feedwater system and the high temperature, high pressure water in the main feedwater system or in the steam generators.

Valve means, such as manual valves 47, normally locked open, are located in the emergency feedwater lines 15 and 17 between the tank 11 and the pumps 23 and 27. These valves isolate an individual pump for maintenance operations, or in the event of a passive failure, such as a pipe leak. Additional valve means 49, such as locked open manual gate valves, are located at each pump discharge, in emergency feedwater lines 15 and 17, which valves are normally locked open and are closed only for pump maintenance.

Check valves are also provided, as indicated at 51, at each pump discharge, in emergency feedwater lines 15 and 17, so as to prevent high pressure discharge from the operating pump from flowing in reverse direction through the non-operating pump and back into the low pressure suction piping and tank. Check valves 53 are also located in each emergency feedwater line 15 and 17 near the point where each of these lines communicate with the main feedwater lines 3. These check valves 53 prevent the flow of high temperature, high pressure water from the main feedwater system or the steam generators into the emergency feedwater lines when the emergency feedwater pumps are not operating.

In order to assure reliability, the two subsystems are separated into two redundant load groups or electrical power trains (not shown). Each of these two electrical power trains is connected to both a preferred and a standby power supply. The preferred power supply consists of one or more circuits from the transmission network (offsite source) and a standby power supply consists of two emergency generators, such as diesel generators. Therefore, the vital bus in each of the two power trains is connected to either an offsite power source or to one emergency generator if offsite power is lost.

During normal plant operation, offsite power is usually supplied through the plant startup transformer. However, should a loss of offsite power occur with a resultant plant trip, the standby power supply of the emergency generators would be available to supply system power requirements. The two electrical power trains provide sufficient physical and electrical separation and redundancy to prevent the occurrence of a common mode failure between the two subsystems. The emergency feedwater system is therefore able to accept a complete loss of one electrical train coincident with a loss of offsite power and still meet all system requirements.

An alternate emergency feedwater source (not shown) is also provided, such as a single tank or reservoir, or several tanks and/or reservoirs. The alternate emergency feedwater source need not be a safety grade, but contains a sufficient quantity of water to allow the plant to be maintained in hot standby condition. Water from the alternate emergency feedwater source is chargeable through line 55 to the emergency feedwater tanks 11.

An orificed recirculating line 57 is provided from each pump discharge back to the emergency feedwater tank 11. The orifice is sized to provide the required amount of recirculation flow for pump protection in the event the discharge flow paths are isolated. While the previous description refers to the components of subsystem A for servicing steam generators $S_1$ and $S_2$, it is to be understood by reference to the drawing, that subsystem B contains the components for servicing steam generators $S_3$ and $S_4$, which are located at a physically distinct location.

The pumps 23 and 27 are sized such that, in events not involving a steamline or feedline rupture, only one pump is capable of supplying the minimum required emergency feedwater flow to the minimum number (2) of steam generators within one minute of system actuation, with the steam generators at a pressure equal to the setpoint of the lowest set safety relief valve in the main steam system, plus the accumulation of the safety valve.

In the event of a main feedline or steamline rupture, it is postulated that none of the emergency feedwater flow in the affected subsystem will reach the steam generators. In such cases, the sizing of the emergency feedwater pumps 23 and 27 is such that either pump in the unaffected subsystem will be capable of supplying the minimum required emergency feedwater flow to the minimum number (2) of effective steam generators with the steam generator pressure as described above.

The steam supply line 29 for each turbine pump 27 is connected to the main steam line from one steam generator only (steam generator $S_1$ for the turbine pump in subsystem A and steam generator $S_3$ for the turbine pump in subsystem B). The steam supply line to each turbine is fitted with a steam admission valve 31 which is a pneumatically-operated valve arranged to fail open on loss of air or electrical power. The steam admission valve 31 uses both subsystem A and subsystem B powered actuation trains to operate redundant solenoid valves to vent the air and open the steam admission valve. This ensures that a single failure of an actuation train will not incapacitate both the turbine driven pump 27 and the motor driven pump 23 in either subsystem.

The emergency feedwater system 1 is not operated during normal plant operations, but remains in a state of readiness to provide emergency feedwater to the steam generators in the event of transient or accident conditions. In the event of such an occurrence, the emergency feedwater pumps are automatically started as follows:

| Signal | Pumps Started |
|---|---|
| Low-Low level in 2/4 level channels in any one steam generator | Motor Driven Pumps 23 |
| Low—low level in 2/4 level channels in any two steam generators | Turbine Driven Pumps 27 |
| Safety Injection | Motor Driven Pumps 23 |

Since all valves in the emergency feedwater lines 15 and 17 are open, the automatic startup of the pump, as indicated above, will result in the immediate delivery of emergency feedwater into the steam generators. The system is designed to supply at least the minimum required flow, within one minute of the actuation signal, to at least 2 effective steam generators, and to continue this delivery for an indefinite period without operator action. When operator action can be taken (after an assumed 30 minute delay) the emergency feedwater flow rate is adjusted by positioning the hand controlled flow modulating valves 35 so as to restore and maintain the steam generator water levels within the narrow control range.

With the reactor tripped, and the emergency feedwater system supplying water to the steam generators at a rate equivalent to the rate at which steam is being removed to dissipate core decay heat and the heat input of one reactor coolant pump (assumed to be operating), the plant is in a stable hot standby condition. The plant can be maintained in this condition for a period limited only by the amount of water in the tank 11 and alternate emergency feedwater source. If the initiating event can be resolved, plant power operations can be resumed. Normal feedwater flow to the steam generators, by the main feedwater system, is resumed and the emergency feedwater pumps are manually stopped. If the initiating event cannot be resolved, a plant cooldown must be performed. In this case, the emergency feedwater system continues to supply feedwater to the system generators throughout the cooldown until the primary system hot leg temperature is reduced to the desired level. The residual heat removal system of the plant is then activated and the emergency feedwater system is secured by manually stopping the emergency feedwater pump. The residual heat removal system continues the cooldown to cold shutdown conditions.

Figure 2:
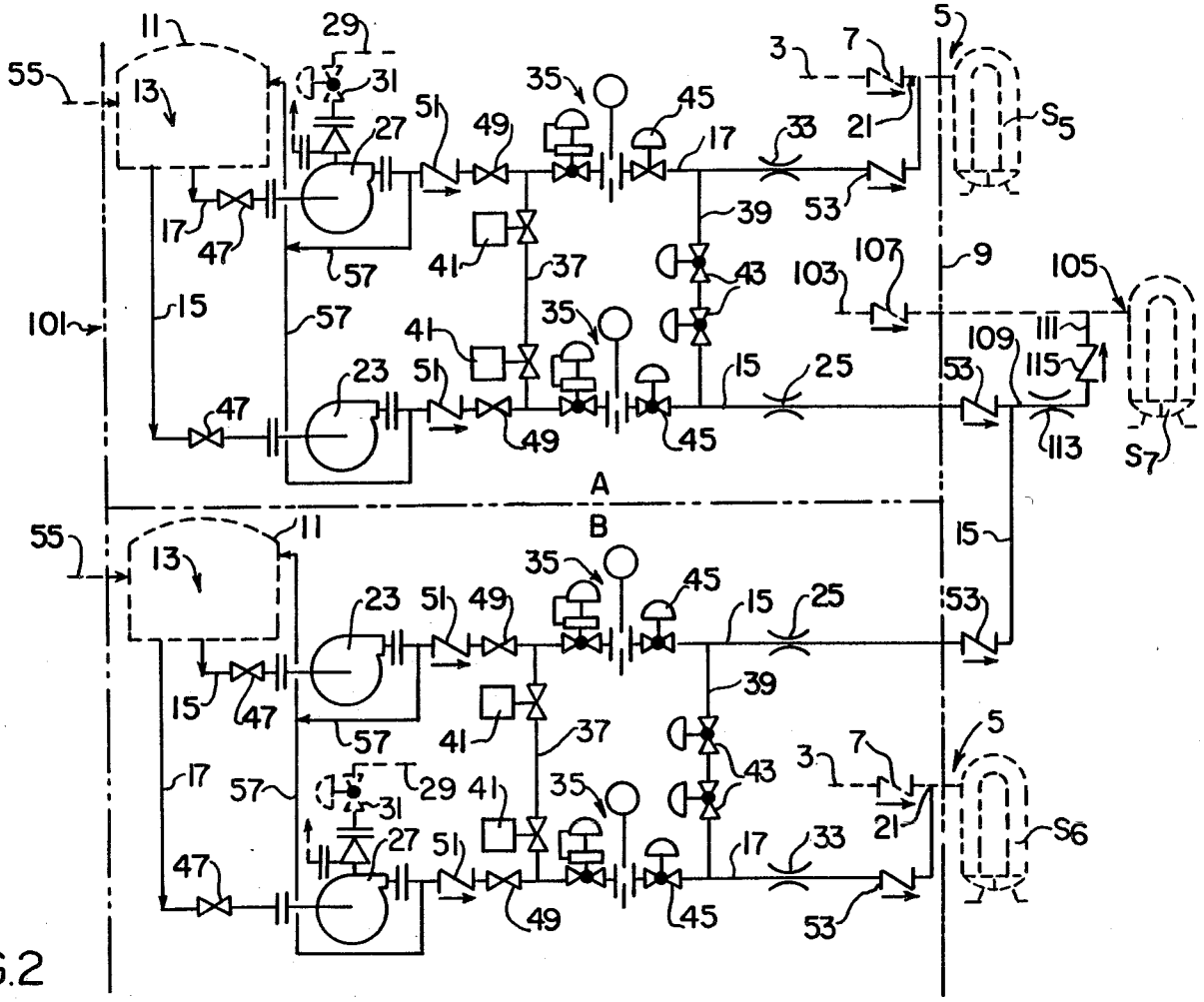
FIG. 2 is a schematic illustration of another embodiment of the emergency feedwater system of a present invention for use with a three loop steam generation system.

An embodiment of the present invention for use with a three loop system, a system containing three steam generators, indicated as $S_5$, $S_6$ and $S_7$, is illustrated in FIG. 2. This embodiment 101 has the components of the four loop embodiment, with the numerals on the components corresponding to those in FIG. 1, with four emergency feedwater lines, 15, 15, 17 and 17 provided, except that one of the feedwater lines 15 and 15 of each subsystem combine to form a common discharge line to the third generator.

As illustrated, emergency feedwater line 17 of subsystem A services steam generator $S_5$, while emergency feedwater line 17 of subsystem B services steam generator $S_6$. The third steam generator $S_7$ has an inlet line 103 connected to a main feedwater system, the line 103 terminating at the steam generator $S_7$ at a nozzle 105, and a check valve 107 is provided in line 103. The other emergency feedwater line 15 of subsystem A and the other emergency feedwater line 5 of subsystem B combine to form a common discharge line 109 which communicates at 111 with inlet line 103 at a location between check valve 107 and nozzle 105. As illustrated, this point of communication 111 may be inside the containment, i.e., on the inside of containment wall 9.

In addition to the cavitating venturis 25 and 33 in emergency feedwater lines 15 and 17, a further cavitating venturi 113 is provided in the common discharge line 109. Also, an additional check valve 115 is provided in common discharge line 109 between the cavitating venturi 113 and the communication 111 of line 109 with inlet line 103.

Figure 3:
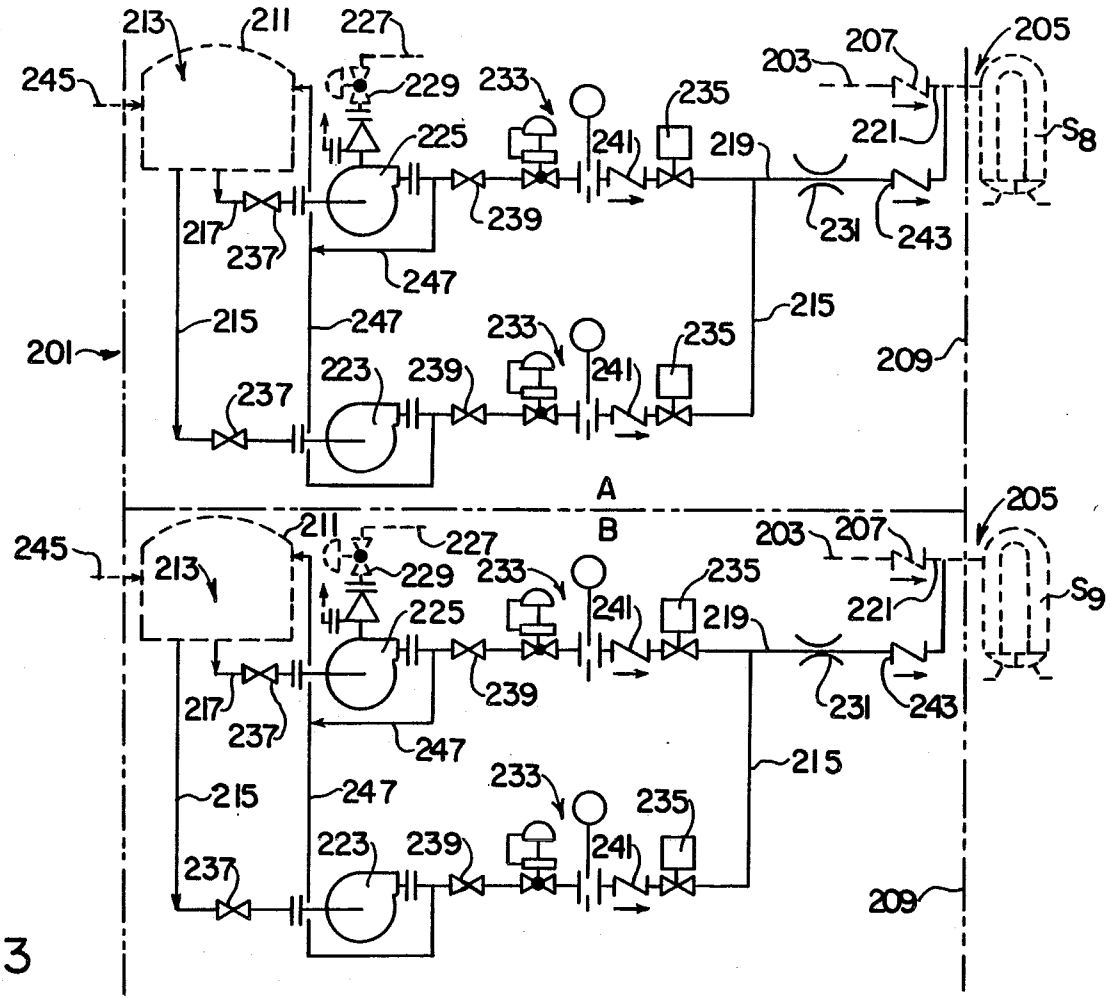
FIG. 3 is a schematic illustration of a further embodiment of the emergency feedwater system of the present invention for use with a two loop steam generation system.

An embodiment of the present invention for use with a two loop system, a system containing two steam generators, indicated as $S_8$ and $S_9$, is illustrated in FIG. 3. This embodiment of the emergency feedwater system 201 also has two subsystems, A and B. Each of the two steam generators $S_8$ and $S_9$ has a main feedwater system which supplies water through an inlet line 203 to a steam generator through a nozzle 205, and a check valve 207 is present in each line 203, outside containment wall 209. There are two subsystems, A and B, provided which are located at physically distinct locations. Referring to subsystem A, which has identical components of subsystem B, an emergency feedwater tank 211 contains a supply of emergency feedwater 213, which is discharged to a pair of emergency feedwater lines 215 and 217. Emergency feedwater lines 215 and 217 combine to form a common discharge line 219, which common discharge line 219 communicates with the inlet line 203 to steam generator $S_8$ at a location between check valve 207 and nozzle 205.

In emergency feedwater line 215, there is provided a motor operated pump 223 which is electrically operated, while in emergency feedwater line 217 there is provided a steam turbine driven pump 225. A steam supply line 227 provides steam from the main steam system of the steam generator $S_8$ and contains a valve means 229, such as a pneumatically-operated, normally-closed, steam admission valve. Activation of either the motor operated pump 223 or the steam driven pump 225 will discharge water from the emergency feedwater tank 211 through the respective emergency feedwater lines 215 and 217. A cavitating venturi orifice 231 is provided in the common discharge line 219.

Flow modulating valves 233 are located in each of the emergency feedwater lines 215 and 217 between the respective pumps 223 and 225 and the common discharge line 219. The flow modulating valves 233 are normally open, fail open, air operated valves having a local manual override. These valves 233 will be normally open when the system is activated. They are provided to allow operator control of the emergency feedwater flow rates to the steam generator so that, in the long term, after operator action can be assumed, steam generator water levels can be maintained in a narrow control range. A safety grade air supply is provided for each valve 233, and a local manual override is provided to allow positioning in the event of loss of air, or a failure in the valve control circuitry. Valve means, such as normally open motor operated valves 235 are provided in each emergency feedwater line 215 and 217 downstream from the flow modulating valves 233. The valves 235 allow the emergency feedwater lines to be remotely isolated for maintenance in the event of a passive failure, such as a pipe leak. These valves 235 are also used to isolate emergency feedwater flow to a faulted steam generator following a minor feedline or main steamline rupture. A local manual override is provided on each valve 235 to allow manual positioning in the event of control failure. Locked open manual gate valves 237 are located between the emergency feedwater tank and each pump, while further locked open manual gate valves 239 are located between each pump and the flow modulating valves 233 in each of the emergency feedwater lines 215 and 217. Valves 237 are used to isolate an individual pump for maintenance operation in the event of a passive failure, such as a pipe leak. Valve 239 are closed only for pump maintenance.

Check valves 241 are provided in each emergency feedwater line 215 and 217 between the respective pumps 223 and 225 and the common discharge line 219. In the event that any one pump in a subsystem is started, these check valves 241 prevent the high pressure discharge of the operating pump from flowing in a reverse direction through the non-operating pump and back into the low pressure emergency feedwater tank 211. Also, a check valve 243 is located in the common discharge line 219 near the point of communication 221 with the main feedwater inlet line 203. This check valve 243 prevents the flow of high temperature, high pressure water from the main feedwater system or the steam generator from flowing into the emergency feedwater system when the emergency feedwater pumps 223 and 225 are not operating.

As with the previous embodiments, two redundant load groups or electrical power trains (not shown) are used with the two subsystems to assure reliability.

An alternate emergency feedwater source (not shown) is provided which charges the feedwater tank 211 through line 245. Also, an orificed recirculation line 247 is provided from each pump discharge back to the emergency feedwater tank 211.

The operation of the subsystem in the two loop embodiment is similar to that of the other embodiment, with the pumps sized such that only one pump in either subsystem is capable of supplying the minimum required feedwater flow to an effective steam generator in the event of a main feedline or steamline rupture affecting one of the steam generators. The steam supply line for each turbine driven pump is connected to the main steamline from one steam generator only, and fitted as in the previously described embodiments.

What is claimed is:

1. In an emergency feedwater system for the steam generators of a pressurized water nuclear reactor power plant adapted to supply emergency feedwater from a storage tank, with pumps provided to direct emergency feedwater to at least one steam generator, when water from a main feedwater system, which feeds through an inlet line containing a check valve and terminating at a feedwater nozzle to a steam generator, is not available, so as to remove heat from the reactor, the improvement comprising:

two separately located subsystems, each subsystem adapted for supplying emergency feedwater to at least one steam generator, each subsystem comprsing;

(a) an emergency feedwater supply tank;

(b) a pair of emergency feedwater lines for discharge of water from the tank, said feedwater lines communicating with the inlet line to a steam generator between the check valve and feedwater nozzle;

(c) an electrically operated motor driven pump in one of said pair of emergency feedwater lines having an electrical power source for activation thereof;

(d) a steam driven pump in the other of said pair of emergency feedwater lines having means for providing steam from a steam generator, to which the said other feedwater line leads, to said pump, and a normally closed valve means associated therewith; and (e) a cavitating venturi in a said emergency feedwater line at a location following said pump and prior to communicating of said feedwater line with said inlet line.

2. In the emergency feedwater system defined in claim 1, the improvement wherein a cavitating venturi is provided in each of said emergency feedwater lines.

3. In the emergency feedwater system defined in claim 2, the improvement wherein four steam generators are provided and one subsystem is provided for two of said four steam generators and another subsystem is provided for two other of said four steam generators.

4. In the emergency feedwater system defined in claim 3, the improvement wherein a flow modulating means is provided in each emergency feedwater line between the pump and said cavitating venturi.

5. In the emergency feedwater system defined in claim 4, the improvement wherein a first connecting line is provided between said pair of emergency feedwater lines at a location between said pumps and said flow modulating means, and valve means are provided in said first connecting line.

6. In the emergency feedwater system defined in claim 5, the improvement wherein a second connecting line is provided between said pair of emergency feedwater lines at a location between said flow modulating means and said cavitating venturi, and valve means are provided in said second connecting line.

7. In the emergency feedwater system as defined in claim 6, the improvement wherein each of said pumps is capable of supplying a sufficient amount of emergency feedwater to two steam generators at a rate equivalent to the rate at which steam is being removed to dissipate at least the core decay heat.

8. In the emergency feedwater system defined in claim 1, the improvement wherein three steam generators are provided and wherein one of each of said pair of emergency feedwater lines of a said subsystem is adapted for discharge of water from a tank to separate first and second steam generators, each of said emergency feedwater lines contains a cavitating venturi downstream of said pump, and the other of each of said pair of emergency feedwater lines combine to form a common discharge line for discharge of water from a tank to a third steam generator, and a further cavitating venturi is provided in said common discharge line.

9. In an emergency feedwater system defined in claim 8, the improvement wherein said motor driven pumps are located in said emergency feedwater lines which combine to form said common discharge line.

10. In the emergency feedwater system as defined in claim 9, the improvement wherein a flow modulating means is provided in each emergency feedwater line between the pump and said cavitating venturi.

11. In the emergency feedwater system as defined in claim 10, the improvement wherein a first connecting line is provided between said pair of emergency feedwater lines, at a location between said pumps and said flow modulating means, and valve means are provided in said first connecting line.

12. In the emergency feedwater system as defined in claim 11, the improvement wherein a second connecting line is provided between said pair of emergency feedwater lines, at a location between said flow modulating means and said cavitating venturies, and valve means are provided is said second connecting line.

13. In the emergency feedwater system defined in claim 1, the improvement wherein two steam generators are provided and wherein each said pair of emergency feedwater lines combine to form a common discharge line, to separate ones of said two steam generators, and a said cavitating venturi is provided in each of said common discharge lines.

14. In the emergency feedwater system defined in claim 13, the improvement wherein a flow modulating means is provided in each emergency feedwater line between the pump and common discharge line.

15. In the emergency feedwater system defined in claim 14, the improvement wherein valve means are provided in each said emergency feedwater line between said flow modulating means and said common discharge line.

* * * * *